US011753801B2

(12) United States Patent
Kondo et al.

(10) Patent No.: US 11,753,801 B2
(45) Date of Patent: Sep. 12, 2023

(54) HYDRAULIC DRIVE SYSTEM

(71) Applicant: KAWASAKI JUKOGYO KABUSHIKI KAISHA, Kobe (JP)

(72) Inventors: Akihiro Kondo, Kobe (JP); Kazuya Iwabe, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 17/287,474

(22) PCT Filed: Dec. 10, 2019

(86) PCT No.: PCT/JP2019/048355

§ 371 (c)(1),
(2) Date: Apr. 21, 2021

(87) PCT Pub. No.: WO2020/122081

PCT Pub. Date: Jun. 18, 2020

(65) Prior Publication Data

US 2021/0395979 A1 Dec. 23, 2021

(30) Foreign Application Priority Data

Dec. 13, 2018 (JP) ..... 2018-233317

(51) Int. Cl.
*E02F 9/24* (2006.01)
*E02F 9/22* (2006.01)
*F15B 11/08* (2006.01)

(52) U.S. Cl.
CPC ..... *E02F 9/24* (2013.01); *E02F 9/22* (2013.01); *F15B 11/08* (2013.01);
(Continued)

(58) Field of Classification Search
CPC ..... F15B 2211/20546; F15B 2211/355; F15B 2211/327; F15B 2211/329; F15B 2211/30515; E02F 9/2285
See application file for complete search history.

(56) References Cited

U.S. PATENT DOCUMENTS 6,761,027 B2 * 7/2004 A'Hearn ..... E02F 9/2203 60/327
9,797,117 B2 * 10/2017 Kubo ..... E02F 9/2285
(Continued)

FOREIGN PATENT DOCUMENTS

CN 105317074 A 2/2016
JP 2009138938 A 6/2009
(Continued)

*Primary Examiner* — Thomas E Lazo
(74) *Attorney, Agent, or Firm* — Alleman Hall Creasman & Tuttle LLP

(57) ABSTRACT

A hydraulic drive system raises and lowers an object by supplying and discharging operating oil to and from each of two ports of an actuator and includes a control device, first to third electromagnetic proportional control valves, a hydraulic pump, a control valve, and a lock valve. When a second pilot pressure is output, the control valve causes the operating oil to be discharged from a first port in order to lower the object. The lock valve is disposed so as to be able to prevent the operating oil from being discharged from the first port by closing a path between the first port and the control valve, and only when a third pilot pressure is output, allows the operating oil to be discharged from the first port by opening the path between the first port and the control valve.

3 Claims, 4 Drawing Sheets

(52) U.S. Cl.
CPC ..... *F15B 2211/20546* (2013.01); *F15B 2211/327* (2013.01); *F15B 2211/329* (2013.01); *F15B 2211/355* (2013.01)

(56) References Cited

U.S. PATENT DOCUMENTS

| | | | | |
|---|---|---|---|---|
| 2009/0145123 | A1 | 6/2009 | Hwang | |
| 2010/0000209 | A1 | 1/2010 | Wada et al. | |
| 2016/0032947 | A1* | 2/2016 | Tanaka | E02F 3/435 60/429 |
| 2017/0166253 | A1 | 6/2017 | Kondo | |
| 2018/0106277 | A1* | 4/2018 | Matsuura | F15B 11/028 |
| 2018/0282974 | A1* | 10/2018 | Kubo | F15B 13/024 |
| 2019/0316611 | A1 | 10/2019 | Kondo et al. | |

FOREIGN PATENT DOCUMENTS

| | | | | | |
|---|---|---|---|---|---|
| JP | 2017110672 | A | | 6/2017 | |
| JP | 2018105333 | A | * | 7/2018 | E02F 9/2296 |
| JP | 2018105333 | A | | 7/2018 | |
| WO | WO-2016167065 | A1 | * | 10/2016 | F15B 11/003 |
| WO | WO-2017051824 | A1 | * | 3/2017 | F15B 11/044 |

* cited by examiner

HYDRAULIC DRIVE SYSTEM

TECHNICAL FIELD

The present invention relates to a hydraulic drive system that, in order to cause an actuator to raise and lower an object, supplies operating oil to the actuator.

BACKGROUND ART

Construction equipment such as an excavator includes various hydraulic actuators such as boom cylinders and arm cylinders and, by using these hydraulic actuators, moves objects, namely, booms and arms. Furthermore, the construction equipment includes a hydraulic drive system and, by using the hydraulic drive system, supplies operating oil to each hydraulic actuator, controls the direction and the flow rate of the operating oil flowing to the hydraulic actuator, and thus controls the operation of the hydraulic actuator. The hydraulic drive system including these functions includes a control valve for each actuator and, by actuating a spool of the control valve, controls the flow direction of the operating oil. Furthermore, in some construction equipment, a pilot pressure to be applied to the spool of the control valve is controlled using an electromagnetic proportional control valve included in the hydraulic drive system.

For example, at the time of actuation of a boom cylinder, when a boom operating device is pulled down to one side in a tilt direction (raising operation), a control device outputs a signal to a boom-raising electromagnetic proportional control valve in accordance with the raising operation. Consequently, a boom-raising pilot pressure is output from the raising electromagnetic proportional control valve, and the spool moves to one side in a predetermined direction, resulting in extension of the boom cylinder. Conversely, when the boom operating device is pulled down to the other side in the tilt direction (lowering operation), the control device outputs a signal to a lowering electromagnetic proportional control valve in accordance with the lowering operation. Consequently, a lowering pilot pressure is output from the lowering electromagnetic proportional control valve, and the spool moves to the other side in the predetermined direction, resulting in retraction of the boom cylinder. In this manner, in the hydraulic drive system, the control device drives each hydraulic actuator by controlling the direction and the flow rate of the operating oil flowing to the hydraulic actuator. A system such as that disclosed in Patent Literature (PTL) 1, for example, is known as the hydraulic drive system.

CITATION LIST

Patent Literature

PTL 1: Japanese Laid-Open Patent Application Publication No. 2017-110672

SUMMARY OF INVENTION

Technical Problem

The system disclosed in PTL 1, which has a function of detecting a malfunction of an electromagnetic proportional control valve upon the occurrence of the malfunction, is configured as follows. Specifically, in the system disclosed in PTL 1, an operation detection line is in communication with each corresponding control valve, and when the spool of the control valve is held in a position deviated from the neutral position, the pressure on the operation detection line increases. For example, in the system disclosed in PTL 1, when the electromagnetic proportional control valve is stuck, an undesired pilot pressure that does not correspond to the amount of operation on an operating device is output, and the spool of the corresponding control valve is held in a position deviated from the neutral position. Consequently, the value of a pressure on the detection line becomes different from that of a pressure thereon obtained when the spool is in the neutral position, and thus it is possible to detect a stuck electromagnetic proportional control valve by comparing the correlation between the amount of operation on the operating device and the pressure on the detection line. At this time, a passage leading from an auxiliary pump to a primary pressure line of the electromagnetic proportional control valve is blocked by the control device, and thus a fail-safe is achieved.

In the system disclosed in PTL 1, when the operating device which actuates all the control valves provided with the operation detection line is in the neutral position and, for example, the electromagnetic proportional control valve which actuates an actuator for lowering an object such as a boom is stuck, lowering of the boom due to a boom cylinder being retracted under the weight of the boom is avoided. However, when a non-boom-related control valve provided with the operation detection line is in operation, it is not possible to detect an abnormality in a boom-lowering control valve. Therefore, achieving the fail-safe for boom lowering even during non-boom-related operation is desired.

Thus, an object of the present invention is to provide a hydraulic drive system capable of achieving the fail-safe even during simultaneous operation of another actuator in the case where an electromagnetic proportional control valve to be used to lower an actuator that could fall under its own weight is stuck.

Solution to Problem

A hydraulic drive system according to the present invention raises and lowers an object by supplying and discharging operating oil to and from each of two ports of an actuator and includes: a control device that outputs a first lowering signal in accordance with a lowering operation performed on an operating device and outputs a raising signal in accordance with a raising operation performed on the operating device, the operation device being used to raise and lower the object; a first electromagnetic proportional control valve that outputs a first pilot pressure corresponding to the raising signal; a second electromagnetic proportional control valve that outputs a second pilot pressure corresponding to the first lowering signal; a third electromagnetic proportional control valve that outputs a third pilot pressure; a hydraulic pump that dispenses the operating oil; a first control valve that is connected to the hydraulic pump and each of the two ports, is actuated in accordance with a difference between the first pilot pressure and the second pilot pressure, and when the first pilot pressure is higher than the second pilot pressure, causes the operating oil dispensed from the hydraulic pump to be supplied to a first port and causes the operating oil to be discharged from a second port in order to raise the object, and when the second pilot pressure is higher than the first pilot pressure, causes the operating oil dispensed from the hydraulic pump to be supplied to the second port and causes the operating oil to be discharged from the first port in order to lower the object, the first port being one of the two ports, the second port being the other of the two ports; and a lock valve that is disposed between the first port and the first control valve, is capable of preventing the operating oil from being discharged from the first port by closing a path between the first port and the first control valve, and only when the third pilot pressure is output, allows the operating oil to be discharged from the first port by opening the path between the first port and the first control valve.

According to the present invention, in the case where the lowering operation on the operating device is not performed, the third pilot pressure is not output from the third electromagnetic proportional control valve, and thus the lock valve prevents the operating oil from being discharged from the first port. In other words, even in the case where the second electromagnetic proportional control valve to be used to lower the object is stuck and the second pilot pressure is output, when the lowering operation on the operating device is not performed, the operating oil can be prevented from being discharged from the first port. This makes it possible to prevent the object from falling unwillingly under its own weight when the lowering operation on the operating device is not performed, in other words, possible to achieve the fail-safe even during simultaneous operation of another actuator in the case where the second electromagnetic proportional control valve is stuck.

Conversely, when the third pilot pressure is output from the third electromagnetic proportional control valve, the lock valve opens the path between the first port and the control valve. Thus, the discharge of the operating oil from the first port is allowed, and the object can be lowered in accordance with the lowering operation on the operating device.

In the above-described invention, the third electromagnetic proportional control valve may be the first electromagnetic proportional control valve, the third pilot pressure may be the first pilot pressure, and when the first pilot pressure that is higher than or equal to a predetermined release pressure is output, the lock valve may open the path between the first port and the first control valve to allow the operating oil to be discharged from the first port, and when the first lowering signal is output, the control device may output a second lowering signal to the first electromagnetic proportional control valve to cause the first electromagnetic proportional control valve to output the first pilot pressure that is the predetermined release pressure.

With the above-described configuration, since the first electromagnetic proportional control valve serves as a substitute for the third electromagnetic proportional control device, there is no need to additionally provide a dedicated electromagnetic proportional control valve to actuate the lock valve, and thus the number of components can be reduced.

The above-described invention may further include: a second hydraulic pump that dispenses the operating oil and is different from a first hydraulic pump that is the hydraulic pump; and a second control valve that is connected to the second hydraulic pump and the first port of a boom cylinder that is the actuator, when the third pilot pressure that is higher than or equal to a predetermined operating pressure is output from the third electromagnetic proportional control valve, causes the operating oil dispensed from the second hydraulic pump to be supplied to the first port in order to raise a boom that is the object. When the third pilot pressure that is a predetermined release pressure lower than the predetermined operating pressure is output, the lock valve may open the path between the first port and the first control valve to allow the operating oil to be discharged from the first port. When the first lowering signal is output, the control device may output a second lowering signal to the third electromagnetic proportional control valve to cause the third electromagnetic proportional control valve to output the third pilot pressure that is the predetermined release pressure.

With the above-described configuration, since the electromagnetic proportional control valve for actuating the lock valve and the electromagnetic proportional control valve for actuating the second control valve are the same, there is no need to additionally provide a dedicated electromagnetic proportional control valve to actuate the lock valve, and thus the number of components can be reduced.

Advantageous Effects of Invention

With the present invention, it is possible to achieve the fail-safe even during simultaneous operation of another actuator in the case where the second electromagnetic proportional control valve to be used to lower an actuator that could fall under its own weight is stuck.

The above object, other objects, features, and advantages of the present invention will be made clear by the following detailed explanation of preferred embodiments with reference to the attached drawings.

DESCRIPTION OF EMBODIMENTS

Hereinafter, hydraulic drive systems 1, 1A, 1B according to Embodiments 1 to 3 of the present invention will be described with reference to the drawings. Note that the concept of directions mentioned in the following description is used for the sake of explanation; the orientations, etc., of elements according to the present invention are not limited to these directions. The hydraulic drive systems 1, 1A, 1B described below are mere embodiments of the present invention. Thus, the present invention is not limited to the embodiments and may be subject to addition, deletion, and alteration within the scope of the essence of the present invention.

Embodiment 1

Figure 1:
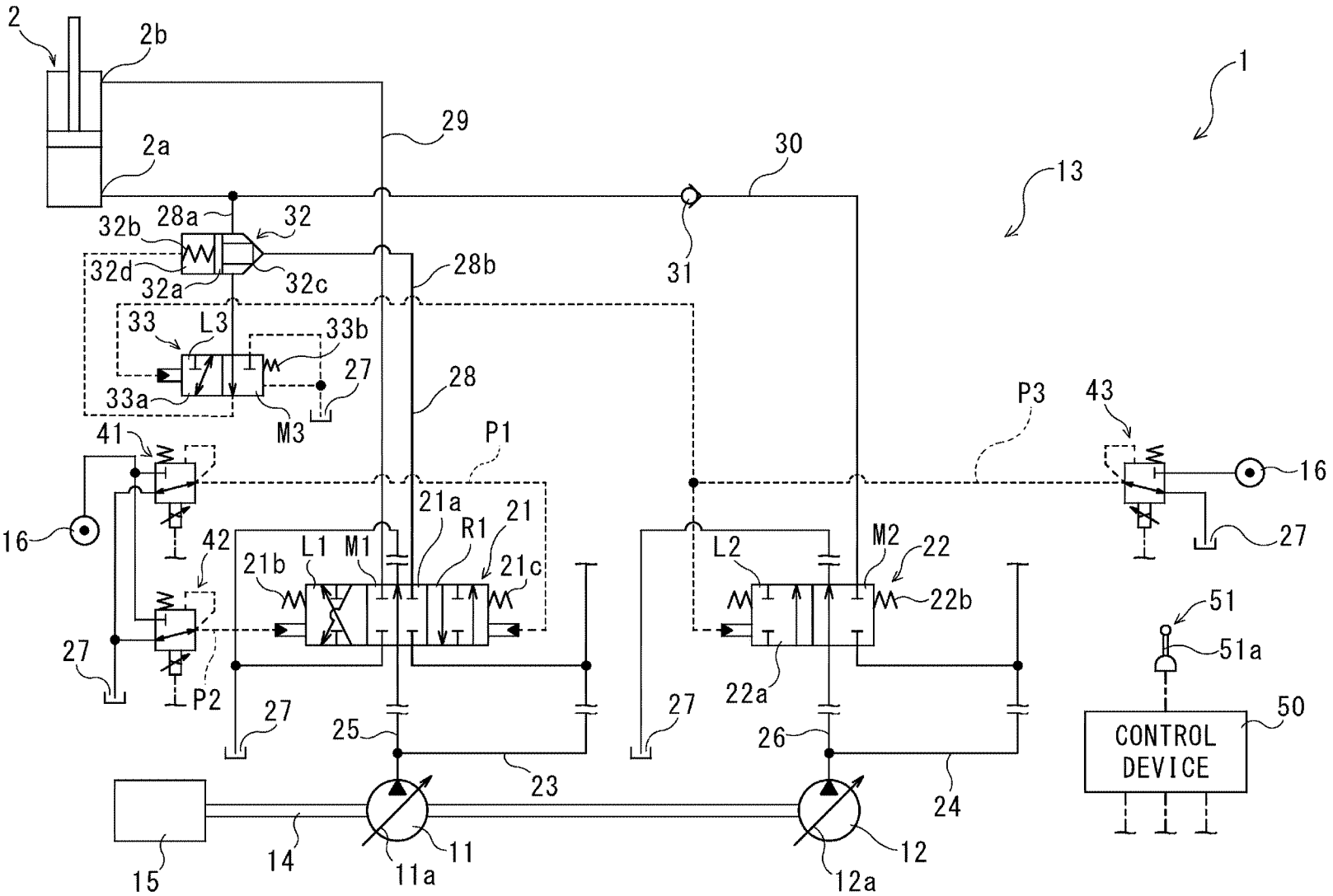
FIG. 1 is a circuit diagram illustrating a hydraulic circuit of a hydraulic drive system according to Embodiment 1 of the present invention.

Construction equipment such as a hydraulic excavator, a wheel loader, and a hydraulic crane includes various attachments such as a bucket and a hydraulic breaker and is capable of moving up and down the attachments by raising and lowering a boom and an arm. In order to raise and lower the boom and the arm, the construction equipment includes various actuators such as a boom cylinder and an arm cylinder, and operating oil is supplied to actuate each actuator. Furthermore, the construction equipment includes a hydraulic drive system 1 such as that illustrated in FIG. 1 and, by using the hydraulic drive system 1, supplies the operating oil to the actuators and discharges return oil to actuate the actuators. Hereinafter, the configuration of the hydraulic drive system 1 included in a hydraulic excavator that is one example of the construction equipment will be described in detail.

<Hydraulic Drive System>

The hydraulic drive system 1 is connected to various actuators such as a boom cylinder 2, an arm cylinder, a bucket cylinder (not illustrated in the drawings) for moving a bucket, a turning motor for moving a turning body to which the boom is attached, and a traveling motor for moving a traveling device, and actuates the various actuators by supplying the operating oil thereto. Note that in FIG. 1, actuators other than the actuator (namely, the boom cylinder 2) for the boom particularly related to the hydraulic drive system 1 according to Embodiment 1 are not illustrated, and detailed description thereof will be omitted below. The same applies to a hydraulic drive system 1A according to Embodiment 2 and a hydraulic drive system 1B according to Embodiment 3.

More specifically, the hydraulic drive system 1 includes two hydraulic pumps 11, 12 and a hydraulic supply device 13. The two hydraulic pumps 11, 12 are, for example, tandem double pumps and can be driven by a shared input shaft 14. Note that two hydraulic pumps 11, 12 do not necessarily need to be the tandem double pumps and may be parallel double pumps or may each be a separately formed signal pump. Furthermore, a drive source 15 such as an engine or an electric motor is connected to the input shaft 14, and rotation of the input shaft 14 by the drive source 15 causes pressure oil to be dispensed from the two hydraulic pumps 11, 12. The two hydraulic pumps 11, 12 configured as just described are so-called variable-capacitance swash plate pumps. Specifically, the two hydraulic pumps 11, 12 include swash plates 11*a*, 12*a*, respectively, and it is possible to change the output capacity by changing the tilt angles of the swash plates 11*a*, 12*a*. Furthermore, tilt angle adjustment mechanisms not illustrated in the drawings are provided on the swash plates 11*a*, 12*a*, and the tilt angles of the swash plates 11*a*, 12*a* are changed using the tilt angle adjustment mechanisms. Note that the hydraulic pumps 11, 12 are not limited to the swash plate pumps and may be bent axis pumps.

The two hydraulic pumps 11, 12 including these functions are connected to a plurality of actuators including the boom cylinder 2 via the hydraulic supply device 13, and the operating oil is supplied to and discharged from each of the actuators via the hydraulic supply device 13. Furthermore, the hydraulic supply device 13 can switch the direction of the operating oil that is supplied to each of the actuators and change the flow rate of the operating oil that is supplied to each of the actuators. Specifically, the drive direction of each of the actuators is switched by switching the direction of the operating oil, and the drive speed of each of the actuators is changed by changing the flow rate of the operating oil. More specifically, the hydraulic supply device 13 includes a directional control valve corresponding to each of the actuators and allows the operating oil to flow to each of the actuators by actuating the corresponding directional control valve.

In other words, the hydraulic supply device 13 includes two boom directional control valves 21, 22 and various directional control valves not illustrated in the drawings such as a pair of traveling directional control valves, a turning directional control valve, an arm directional control valve, and a bucket directional control valve. Each of these directional control valves corresponds to one of the two hydraulic pumps 11, 12 and is connected in parallel with the corresponding one of the hydraulic pumps 11, 12. For example, one of the traveling directional control valves, the first boom directional control valve 21, which is one of the boom directional control valves, the bucket directional control valve, and the like are connected in parallel with the first hydraulic pump 11, which is one of the hydraulic pumps, via a first main passage 23, and the other of the traveling directional control valves, the second boom directional control valve 22, which is the other of the boom directional control valves, the turning directional control valve, and the arm directional control valve are connected in parallel with the second hydraulic pump 12, which is the other of the hydraulic pumps, via a second main passage 24. Note that the boom directional control valves 21, 22, which correspond to the boom cylinder 2, the pair of traveling directional control valves, which correspond to the traveling device, the turning directional control valve, which corresponds to the turning motor, the arm directional control valve, which corresponds to the arm cylinder, and the bucket directional control valve, which corresponds to the bucket cylinder, are connected to the hydraulic pumps 11, 12.

Furthermore, the hydraulic pumps 11, 12 are connected to first and second bypass passages 25, 26, respectively, and the operating oil dispensed from the hydraulic pumps 11, 12 is discharged to a tank 27 via the first and second bypass passages 25, 26. Moreover, one of the traveling directional control valves, the first boom directional control valve 21, the bucket directional control valve, and the like are connected in series with the first bypass passage 25, and when these directional control valves are actuated, the first bypass passage 25 is closed, and the operating oil is supplied to the actuators corresponding to the directional control valves. Meanwhile, the other of the traveling directional control valves, the second boom directional control valve 22, the turning directional control valve, the arm directional control valve, and the like are connected in series with the second bypass passage 26, and when these directional control valves are actuated, the second bypass passage 26 is closed, and the operating oil is supplied to the actuators corresponding to the directional control valves. These directional control devices are actuated in accordance with the operation on the operating device (not illustrated in FIG. 1 except elements for the boom directional control valves 21, 22) and supply the operating oil to the corresponding actuators at a flow rate corresponding to the amount of operation, in other words, actuate the corresponding actuators at a drive speed corresponding to the amount of operation. Hereinafter, the directional control valves for actuating the boom particularly related to the hydraulic drive system 1 according to Embodiment 1, namely, the first and second boom directional control valves 21, 22, will be described in detail.

The first and second boom directional control valves 21, 22 are valves for controlling the operation of the boom cylinder 2 and are connected to the first and second hydraulic pumps 11, 12, respectively, as mentioned earlier. Specifically, the first boom directional control valve 21, which is one example of the first control valve, is connected to the first hydraulic pump 11 via the first main passage 23 and the first bypass passage 25. Furthermore, the first boom directional control valve 21 is connected to the boom cylinder 2 and the tank 27 directly or via a lock valve 32 to be described later, switches the connection states thereof to switch the flow direction of the operating oil, and thus extends and retracts the boom cylinder 2.

More specifically, the boom cylinder 2, which is one example of the first actuator, is a double-acting cylinder and includes two ports 2*a*, 2*b*. Specifically, when the operating oil is supplied to one of the ports, namely, the head-end port 2*a* (the first port), and the operating oil is discharged from the other of the ports, namely, the rod-end port 2*b* (the second port), the boom cylinder 2 extends. Conversely, when the operating oil is discharged from the head-end port 2*a*, the boom cylinder 2 is retracted. In the boom cylinder 2 configured as just described, the ports 2*a*, 2*b* thereof are connected to the first boom directional control valve 21 via a head-end passage 28 and a rod-end passage 29, respectively, and the first boom directional control valve 21 switches the connection points of the two passages 28, 29 to extend and retract the boom cylinder 2. The first boom directional control valve 21 including these functions is a three-function directional control valve and includes a spool 21*a*.

The spool 21*a* is capable of moving from a neutral position M1 to each of a first offset position R1 and a second offset position L1; when the spool 21*a* is in the neutral position M1, the spool 21*a* blocks all the paths between the two passages 28, 29, the first main passage 23, and the tank 27. At this times, the first bypass passage 25 is open, and the operating oil from the first hydraulic pump 11 flows downstream of the first boom directional control valve 21 (in other words, toward other directional control valves such as the bucket directional control valve) through the first bypass passage 25 accordingly. When the spool 21*a* moves to the first offset position R1, the head-end passage 28 is connected to the first main passage 23, and the rod-end passage 29 is connected to the tank 27. This causes the operating oil to be supplied to the head-end port 2*a* and be discharged from the rod-end port 2*b*, resulting in extension of the boom cylinder 2. When the spool 21*a* moves to the second offset position L1, the head-end passage 28 is connected to the tank 27, and the rod-end passage 29 is connected to the first main passage 23. This makes it possible to discharge the operating oil in the head-end port 2*a*, enabling retraction of the boom cylinder 2. Note that when the spool 21*a* is at each of the offset positions R1, L1, the first bypass passage 25 is closed, and the operating oil from the first hydraulic pump 11 is kept from being guided to the tank 27 through the first bypass passage 25. Thus, it is possible to supply the operating oil to the boom cylinder 2.

As described above, in the hydraulic supply device 13, the flow direction and the flow rate of the operating oil that is dispensed from the first hydraulic pump 11 are controlled using the first boom directional control valve 21, and thus the boom cylinder 2 can be extended and retracted to allow the boom to swing vertically. In order to cause the boom to swing upward (in other words, in order to raise the boom), it is necessary to move the boom against gravity, and the operating oil needs to be supplied to the boom cylinder 2 at a flow rate greater than in the case of causing the boom to swing downward. Therefore, the hydraulic supply device 13 is configured so that the operating oil can be supplied not only from the first hydraulic pump 11, but also from the second hydraulic pump 12, to the boom cylinder 2; in order to provide this function, the hydraulic supply device 13 includes the second boom directional control valve 22.

The second boom directional control valve 22, which is one example of the second control valve, is a valve that controls the operation (more specifically, the extension) of the boom cylinder 2 in cooperation with the first boom directional control valve 21, and is connected to the second hydraulic pump 12 via the second main passage 24 and the second bypass passage 26. Furthermore, the second boom directional control valve 22 is connected to the head-end port 2*a* of the boom cylinder and the tank 27, switches the connection between the second main passage 24 and the head-end port 2*a* and the opening/closing of the second bypass passage 26 to switch the flow direction of the operating oil, and thus extends the boom cylinder 2.

More specifically, the second boom directional control valve 22 is connected to the head-end port 2*a* via a boom merging passage 30. In other words, the boom merging passage 30 is connected to the head-end passage 28, and the second boom directional control valve 22 is connected to the head-end port 2*a* via the boom merging passage 30 and the head-end passage 28. Furthermore, there is a check valve 31 in the boom merging passage 30. The check valve 31 allows the operating oil to flow from the second boom directional control valve 22 toward the head-end port 2*a* and prevents the operating oil from flowing from the head-end port 2*a* toward the second boom directional control valve 22. The connection between the boom merging passage 30 configured as just described and the second main passage 24 is switched using the second boom directional control valve 22; when these passages are connected, the flow of the operating oil from the second hydraulic pump 12 merges with the flow of the operating oil from the first hydraulic pump 11, and thus the operating oil can be supplied to the head-end port 2*a*. The second boom directional control valve 22 including these functions is a two-function directional control valve and includes a spool 22*a*.

The spool 22*a* is capable of moving between a neutral position M2 and an offset position L2; when the spool 22*a* is in the neutral position M2, the spool 22*a* blocks the path between the boom merging passage 30 and the second main passage 24. At this times, the second bypass passage 26 is open, and the operating oil from the second hydraulic pump 12 flows downstream of the second boom directional control valve 22 (in other words, toward other directional control valves such as the turning directional control valve and the arm directional control valve) through the second bypass passage 26 accordingly. When the spool 22*a* moves to the offset position L2, the boom merging passage 30 is connected to the second main passage 24, and the operating oil from the second hydraulic pump 12 is guided to the head-end passage 28 via the boom merging passage 30. Consequently, in the head-end passage 28, the flow of the operating oil from the second hydraulic pump 12 merges with the flow of the operating oil from the first hydraulic pump 11, and thus a large quantity of operating oil can be guided to the head-end port 2*a*. In other words, in the hydraulic supply device 13, upon raising the boom, the operating oil from the two hydraulic pumps 11, 12 can merge and be guided to the boom cylinder 2.

The two boom directional control valves 21, 22 configured as just described are pilot spool valves, and the spools 21*a*, 22*a* move by receiving pilot pressures P1 to P3. Specifically, the first pilot pressure P1 and the second pilot pressure P2 act on both ends of the spool 21*a* so as to oppose each other, and the spool 21*a* moves to a position corresponding to the difference between these two pilot pressures, that is, P1−P2. For example, when the first pilot pressure P1 is higher than the second pilot pressure P2, the spool 21*a* moves to the first offset position R1, and when the first pilot pressure P1 is lower than the second pilot pressure P2, the spool 21*a* moves to the second offset position L1.

More specifically, a pair of spring members 21*b*, 21*c* are provided on the spool 21*a*, and the spring members 21*b*, 21*c* provide the biasing force against the first pilot pressure P1 and the second pilot pressure P2 to the spool 21*a*. Therefore, the spool 21*a* is maintained in the neutral position M1 by the pair of spring members 21*b*, 21*c*, and when the absolute value of the difference between the pressures, |P1−P2|, becomes greater than or equal to predetermined operating pressures PS1, PS2 corresponding to the biasing force of the spring members 21*b*, 21*c*, the spool 21*a* moves to the offset positions R1, L1. Specifically, when the first pilot pressure P1 is higher than the second pilot pressure P2 and the difference between the pressures P1−P2 is greater than or equal to the first operating pressure PS1, the spool 21*a* moves to the first offset position R1. When the first pilot pressure P1 is lower than the second pilot pressure P2 and the difference between the pressures, P1−P2, is greater than or equal to the second operating pressure PS2, the spool 21*a* moves to the second offset position L1. After the movement, the spool 21*a* moves through a stroke corresponding to the aforementioned difference between the pressures, P1−P2, and connects each of the passages 23, 25, 28, 29 and the tank 27 with the degree of opening corresponding to the stroke. In other words, the first boom directional control valve 21 connects each of the passages 23, 25, 28, 29 and the tank 27 with the degree of opening corresponding to the difference between the pressures, P1−P2.

Figure 2:
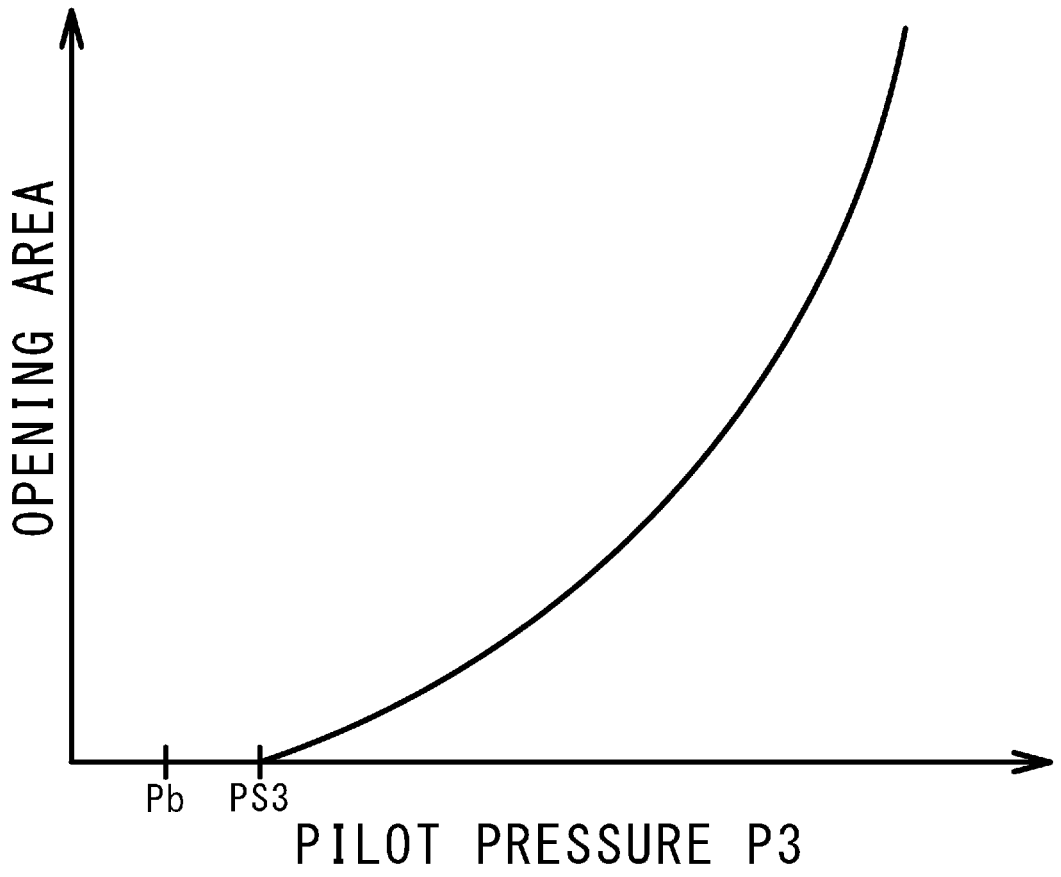
FIG. 2 is a graph illustrating the relationship between a pilot pressure output from a first electromagnetic proportional control valve and the opening area of a first boom directional control valve in the hydraulic drive system illustrated in FIG. 1.

Meanwhile, the pilot pressure, specifically, the third pilot pressure P3, acts on only one end of the spool 22*a* of the second boom directional control valve 22, and the spool 22*a* moves depending on the third pilot pressure P3. Furthermore, a spring member 22*b* is provided on the spool 22*a*, and the spool 22*a* is biased against the third pilot pressure P3 using the spring member 22*b*. Therefore, when the third pilot pressure P3 becomes higher than or equal to a predetermined operating pressure PS3 corresponding to the biasing force of the spring member 22*b*, the spool 22*a* moves to the offset position L2 (refer to the graph in FIG. 2). After the movement, the spool 22*a* moves through a stroke corresponding to the third pilot pressure P3, and the boom merging passage 30 and the second main passage 24 are connected with the degree of opening corresponding to the stroke. In other words, the second boom directional control valve 22 also connects the boom merging passage 30 and the second main passage 24 with the degree of opening corresponding to the third pilot pressure P3.

Thus, in the two boom directional control valves 21, 22, the degree of opening for each of the passages 23 to 26, 28, 29 and the tank 27 which are connected to each other is controlled according to the pilot pressures P1 to P3 provided to the spools 21*a*, 22*a*. First and second electromagnetic proportional control valves 41, 42 are connected to the first boom directional control valve 21 configured as just described, in order to provide the pilot pressures P1, P2 to the spool 21*a* of the first boom directional control valve 21, and a third electromagnetic proportional control valve 43 is connected to the second boom directional control valve 22 in order to provide the pilot pressure P3 to the spool 22*a* of the second boom directional control valve 22.

The first to third electromagnetic proportional control valves 41 to 43 are each connected to the pilot pump 16 (for example, a gear pump), reduce the pressure of pilot oil dispensed from the pilot pump 16, and output the pilot oil to the corresponding spools 21*a*, 22*a*. Specifically, the first pilot pressure P1 is output from the first electromagnetic proportional control valve 41 and is provided to one end of the spool 21*a*. The second pilot pressure P2 is output from the second electromagnetic proportional control valve 42 and is provided to the other end of the spool 21*a*. The third pilot pressure P3 is output from the third electromagnetic proportional control valve 43 and is provided to the spool 22*a*. Note that the electromagnetic proportional control valves 41 to 43 are electromagnetic proportional control valves of the direct proportional type and output the pilot pressures P1 to P3 having values corresponding to signals (for example, electric currents or voltages) input to the electromagnetic proportional control valves 41 to 43. The electromagnetic proportional control valves 41 to 43 configured as just described are connected to a control device 50 in order to control the operation of the electromagnetic proportional control valves 41 to 43.

The control device 50 outputs the signals to the electromagnetic proportional control valves 41 to 43 in order to control the operation of the electromagnetic proportional control valves 41 to 43. A boom operating device 51 is electrically connected to the control device 50. The boom operating device 51, which is one example of the first operating device, is, for example, an electric joystick and a hydraulic operation valve and is used to operate the boom. More specifically, the boom operating device 51 includes an operating lever 51*a* and is configured so that the operating lever 51*a* can be pulled down to one side and the other side in a predetermined tilt direction. Furthermore, the boom operating device 51 outputs, to the control device 50, signals corresponding to the direction and extent of tilting of the operating lever 51*a*, and the control device 50 outputs the signals to the electromagnetic proportional control valves 41 to 43 according to the signals received from the boom operating device 51.

More specifically, when the operating lever 51*a* is pulled down to one side in the tilt direction in order to raise the boom (in other words, the raising operation is performed), the control device 50 outputs, to the first electromagnetic proportional control valve 41 and the third electromagnetic proportional control valve 43, first and second raising signals having values (specifically, electric current values or voltage values) corresponding to the extent of tilting of the operating lever 51*a* on the basis of the signals output from the boom operating device 51. Accordingly, the pilot pressures P1, P3 are output from the first and third electromagnetic proportional control valves 41, 43, and the hydraulic pressures of the two hydraulic pumps 11, 12 are guided to the head-end port 2*a* via the first and second boom directional control valves 21, 22. Thus, the boom cylinder 2 is extended, and the boom is raised. Conversely, when the operating lever 51*a* is pulled down to the other side in the tilt direction in order to lower the boom (in other words, the lowering operation is performed), the control device 50 outputs, to the second electromagnetic proportional control valve 42, a first lowering signal having a value (specifically, an electric current value or a voltage value) corresponding to the extent of tilting of the operating lever 51*a* on the basis of the signals output from the boom operating device 51. Accordingly, the pilot pressure P2 is output from the second electromagnetic proportional control valve 42, enabling the operating oil discharged from the head-end port 2*a* to return to the tank 27 via the first boom directional control valve 21. Furthermore, as a result of the operating oil discharged from the head-end port 2*a* returning to the tank 27, the boom cylinder 2 is retracted, allowing the boom to be lowered.

The hydraulic supply device 13 configured as just described further includes the lock valve 32 in order to hold the boom in place. The lock valve 32 is located in the head-end passage 28, on the first boom directional control valve 21 side relative to the junction between the head-end passage 28 and the boom merging passage 30, and is configured to allow opening and closing of the head-end passage 28. More specifically, the lock valve 32 includes a plunger 32*a* and a spring member 32*b*. The plunger 32*a* closes the head-end passage 28 by moving to a closed position at which the plunger 32*a* is seated on a valve seat 32*c*, and opens the head-end passage 28 by moving to an open position at which the plunger 32*a* is lifted off the valve seat 43*c* (in other words, allowing discharge of an operating fluid). The spring member 32*b* is provided on the plunger 32*a* which moves as just described; the spring member 32*b* biases the plunger 32*a* in a direction in which the plunger 32*a* is seated on the valve seat 32*c*, namely, a closing direction. Furthermore, the following pressure acts on the plunger 32*a* to oppose the biasing force of the spring member 32*b*. Specifically, the lock valve 32 is located in the head-end passage 28, as mentioned above, and the head-end passage 28 includes: a port-end section 28*a* located on the head-end port 2*a* side of the lock valve 32; and a valve-end section 28*b* located on the first boom directional control valve 21 side of the lock valve 32. The plunger 32*a* is under the hydraulic pressures of these port-end section 28*a* and valve-end section 28*b* in a direction opposing the biasing force of the spring member 32*b*, namely, an opening direction in which the plunger 32*a* is lifted off the valve seat 32*c*. Furthermore, a pilot chamber (spring chamber) 32*d* is formed in the lock valve 32, and the plunger 32*a* is under the hydraulic pressure of the pilot chamber 32*d* in a direction opposing the hydraulic pressures of the port-end section 28*a* and the valve-end section 28*b*, namely, the closing direction.

In the lock valve 32 configured as just described, the plunger 32*a* moves to one of the closed position and the open position according to the force relationship between the hydraulic pressures of the port-end section 28*a* and the valve-end section 28*b*, the biasing force of the spring member 32*b*, and the hydraulic pressure of the pilot chamber 32*d*. Stated briefly, the plunger 32*a* is configured to move to one of the closed position and the open position according to the level of the hydraulic pressure of the pilot chamber 32*d*, and a selective valve 33 is connected to the pilot chamber 32*d*.

The selective valve 33 is a two-function directional switch valve and includes a spool 33*a*. The spool 33*a* is capable of moving between a neutral position M3 and an offset position L3. The spool 33*a* in the neutral position M3 connects the pilot chamber 32*d* to the port-end section 28*a* of the head-end passage 28. Thus, the hydraulic pressure of the port-end section 28*a* of the head-end passage 28 is guided to the pilot chamber 32*d*, and the hydraulic pressure of the pilot chamber 32*d* becomes approximately equal to the hydraulic pressure of the port-end section 28*a*. When the spool 21*a* of the first boom directional control valve 21 is in the neutral position or the boom lowering position, the hydraulic pressure of the valve-end section 28*b* that acts on the plunger 32*a* is lower than the hydraulic pressure of the port-end section 28*a*. Therefore, the head-end passage 28 is closed by the plunger 32*a*. However, when the spool 33*a* moves to the offset position L3, the pilot chamber 32*d* is connected to the tank 27. This means that the hydraulic pressure of the pilot chamber 32*d* matches the tank pressure, and the head-end passage 28 is opened due to the hydraulic pressures of the port-end section 28*a* and the valve-end section 28*b* that act on the plunger 32*a*.

In this manner, the selective valve 33 is capable of opening and closing the head-end passage 28 by moving the spool 33*a* of the selective valve 33 and changing the hydraulic pressure of the pilot chamber 32*d*. A spring member 33*b* is provided on the spool 33*a* of the selective valve 33 including these functions, and the spool 33*a* is biased to the neutral position M3 using the spring member 33*b*. Furthermore, the pilot pressure P3 acts on the spool 33*a* so as to oppose the biasing force of the spring member 33*b*, and when the pilot pressure P3 higher than or equal to a predetermined release pressure Pb, which is determined according to the biasing force of the spring member 33*b*, acts on the spool 33*a*, the spool 33*a* moves from the neutral position M3 to the offset position L3. The third electromagnetic proportional control valve 43 is connected to the spool 33*a* configured as described above, in order to provide the pilot pressure P3 to the spool 33*a*.

The spool 22*a* of the second boom directional control valve 22 is connected to the third electromagnetic proportional control valve 43 as mentioned above, and in addition, the spool 33*a* of the selective valve 33 is connected in parallel with the second boom directional control valve 22. This means that the third electromagnetic proportional control valve 43 outputs the third pilot pressure P3 to the spool 33*a* in addition to the spool 22*a*. Therefore, when the operating lever 51*a* is pulled down to one side in the tilt direction and the second raising signal is output from the control device 50 to the third electromagnetic proportional control valve 43, the third pilot pressure P3 is also provided to the spool 33*a* of the selective valve 33. Thus, the spool 33*a* moves to the offset position L3, and the hydraulic pressure of the pilot chamber 32*d* becomes approximately equal to the tank pressure. This allows the plunger 32*a* to move in the opening direction, allowing the operating oil to flow from the first boom directional control valve 21 toward the head-end port 2*a*. Therefore, even with the lock valve 32 in the head-end passage 28, the operating oil from the two hydraulic pumps 11, 12 can merge and be guided to the head-end port 2*a*.

When the operating lever 51*a* is pulled down to the other side in the tilt direction in order to lower the boom, that is, when the control device 50 outputs the first lowering signal, the control device 50 further outputs a second lowering signal to the third electromagnetic proportional control valve 43. Thus, the third electromagnetic proportional control valve 43 outputs the third pilot pressure P3 that is the release pressure Pb to both the spool 22*a* of the second boom directional control valve 22 and the spool 33*a* of the selective valve 33. The release pressure Pb that is output here is lower than the operating pressure PS3, and thus the spool 22*a* of the second boom directional control valve 22 stops in the neutral position M2 in which the opening area is zero (refer to the graph in FIG. 2). Meanwhile, at the selective valve 33, since the output third pilot pressure P3 is the release pressure Pb, the spool 33*a* moves to the offset position L3, and the plunger 32*a* of the lock valve 32 moves to the open position. Thus, the head-end passage 28 is opened, allowing the operating oil to be discharged to the tank 27 from the head-end port 2*a* via the first boom directional control valve 21. This causes the boom cylinder 2 to be retracted, allowing the boom to be lowered.

Furthermore, in the case where the operating lever 51*a* is not operated, the control device 50 does not output the second raising signal or the second lowering signal, and the third pilot pressure P3 is substantially zero. Therefore, the spool 33*a* of the selective valve 33 is maintained in the neutral position M3, and the hydraulic pressure of the port-end section 28*a* is guided to the pilot chamber 32*d* of the lock valve 32. Thus, the plunger 32*a* moves to the closed position, and the head-end passage 28 is closed. The boom merging passage 30 is also closed by the check valve 31, and thus the path between the head-end port 2*a* and the first and second boom directional control valves 21, 22 is completely blocked, and the operating oil is prevented from being discharged from the head-end port 2*a*. With the lock valve 32 disposed so as to be able to prevent the discharge of the operating oil as just described, the boom is held in place in the case where the operating lever 51*a* is not operated.

In the hydraulic drive system 1 configured as describe above, when the second electromagnetic proportional control valve 42 malfunctions, that is, when the second electromagnetic proportional control valve 42 is stuck with a valve body thereof bringing the primary side and the secondary side into communication with each other, the second pilot pressure P2 higher than or equal to the operating pressure PS2 always acts on the spool 21*a* of the first boom directional control valve 21. With this, the spool 21*a* of the first boom directional control valve 21 is held in the second offset position L1. This results in constant connection of the head-end passage 28 to the tank 27. On the other hand, in the hydraulic drive system 1, the lock valve 32 opens the head-end passage 28 to allow the operating oil to be discharged from the head-end port 2*a* only when the third pilot pressure P3 that is the release pressure Pb is output, and thus the following fail-safe can be achieved in the aforementioned stuck state.

Specifically, in the case where the operating lever 51*a* is not operated, the control device 50 does not output the second raising signal or the second lowering signal, and thus the closed state of the head-end passage 28 is maintained, as mentioned earlier. Therefore, in the case where the operating lever 51*a* is not operated, even when the second electromagnetic proportional control valve 42 malfunctions and is stuck with the valve body thereof bringing the primary side and the secondary side into communication with each other, the operating oil in the head-end port 2*a* is not discharged. This means that the boom can be held in place and it is possible to prevent the boom from falling unwillingly under its own weight. Thus, the hydraulic drive system 1 is capable of achieving the fail-safe even during simultaneous operation of another actuator (in other words, during operation of another operating device) in the case where the valve body of the second electromagnetic proportional control valve 42 is stuck.

When the operating lever 51*a* is pulled down to the other side in the tilt direction in order to lower the boom, the second lowering signal is input to the third electromagnetic proportional control valve 43, and the third pilot pressure P3 is output from the third electromagnetic proportional control valve 43 to the spool 33*a* of the selective valve 33. With this, the spool 33*a* moves to the offset position L3, and the pilot chamber 32*d* of the lock valve 32 is brought into communication with the tank 27 accordingly. Consequently, the pressure of the head-end passage 28 causes the plunger 32*a* to move in a direction opposing the spring member 32*b*, and the port-end section 28*a* and the valve-end section 28*b* of the head-end passage 28 are brought into communication with each other. Thus, the discharge of the operating oil from the head-end port 2*a* to the tank 27 is allowed, and the boom can be lowered.

In the hydraulic drive system 1 configured as described above, the third electromagnetic proportional control valve 43 for actuating the second boom directional control valve 22 is also used as an electromagnetic proportion valve for actuating the selective valve 33, that is, for actuating the lock valve 32. Therefore, there is no need to additionally provide a dedicated electromagnetic proportional control valve to actuate the lock valve 32, and thus the number of components can be reduced.

Embodiment 2

The hydraulic drive system 1A according to Embodiment 2 is similar in configuration to the hydraulic drive system 1 according to Embodiment 1. Therefore, the configuration of the hydraulic drive system 1A according to Embodiment 2 will be described focusing on differences from the hydraulic drive system 1 according to Embodiment 1; elements that are the same as those of the hydraulic drive system 1 according to Embodiment 1 share the same reference signs, and as such, description of the elements will be omitted. Note that the same applies to the hydraulic drive system 1B according to Embodiment 3 to be described later.

Figure 3:
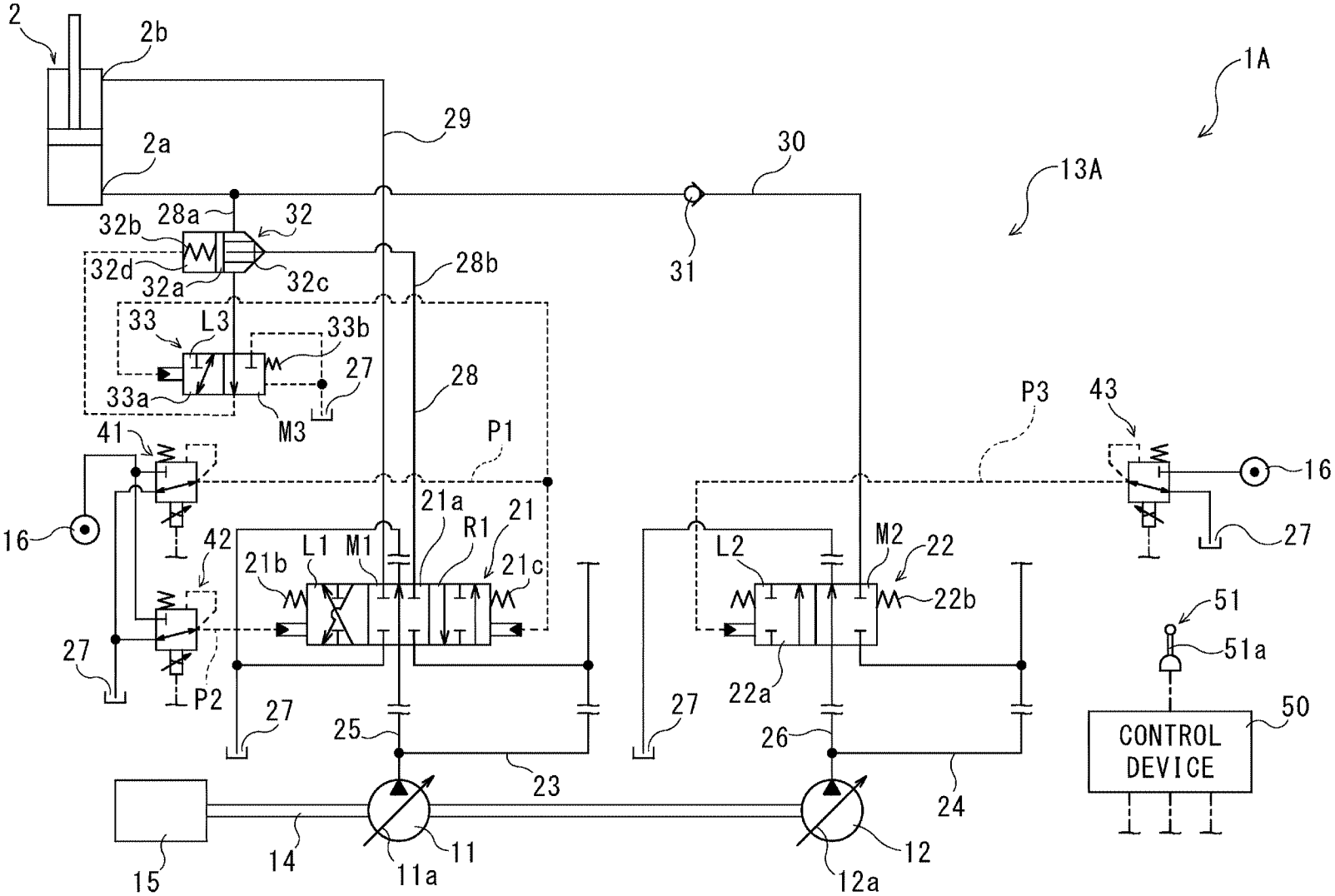
FIG. 3 is a circuit diagram illustrating a hydraulic circuit of a hydraulic drive system according to Embodiment 2.

In a hydraulic supply device 13A in the hydraulic drive system 1A according to Embodiment 2, the first electromagnetic proportional control valve 41 is connected to the spool 33*a* of the selective valve 33, as illustrated in FIG. 3. Specifically, the first electromagnetic proportional control valve 41 is connected in parallel with the spool 21*a* of the first boom directional control valve 21 and the spool 33*a* of the selective valve 33, and the first pilot pressure P1 that is output from the first electromagnetic proportional control valve 41 is provided to both the spools 21*a*, 33*a*. In other words, when the operating lever 51*a* is pulled down to one side in the tilt direction and the first raising signal is output from the control device 50 to the first electromagnetic proportional control valve 41, the first pilot pressure P1 is also provided to the spool 33*a* of the selective valve 33. Thus, the spool 33*a* moves to the offset position L3, and the pilot chamber 32*d* of the lock valve 32 is brought into communication with the tank 27 accordingly. Consequently, the pressure of the head-end passage 28 causes the plunger 32*a* to move in the direction opposing the spring member 32*b*, and the port-end section 28*a* and the valve-end section 28*b* of the head-end passage 28 are brought into communication with each other. Therefore, the flow of the operating oil from the first boom directional control valve 21 to the head-end port 2*a* is allowed, and the operating oil from the two hydraulic pumps 11, 12 can merge and be guided to the head-end port 2*a*.

When the operating lever 51*a* is pulled down to the other side in the tilt direction in order to lower the boom, that is, when the control device 50 outputs the first lowering signal, the control device 50 further outputs the second lowering signal to the first electromagnetic proportional control valve 41. Thus, the first electromagnetic proportional control valve 41 outputs the third pilot pressure P3 that is the release pressure Pb to both the spool 21*a* of the first boom directional control valve 21 and the spool 33*a* of the selective valve 33. Here, the release pressure Pb is lower than the second pilot pressure P2, which the second electromagnetic proportional control valve 42 outputs according to the first lowering signal, and is preferably lower than the operating pressure PS1. When the first pilot pressure P1 that is the release pressure Pb as just described is output, the spool 33*a* of the selective valve 33 can be moved to the offset position L3 while the spool 21*a* of the first boom directional control valve 21 is moved to the second offset position L1. Thus, the pilot chamber 32*d* of the lock valve 32 is brought into communication with the tank 27, the pressure of the head-end passage 28 causes the plunger 32*a* to move in the direction opposing the spring member 32*b*, and the port-end section 28*a* and the valve-end section 28*b* of the head-end passage 28 are brought into communication with each other. Therefore, the operating oil can be guided from the head-end port 2*a* to the first boom directional control valve 21.

Furthermore, in the case where the operating lever 51*a* is not operated, the control device 50 does not output the first raising signal or the second lowering signal, and the first pilot pressure P1 is substantially zero. Therefore, the spool 33*a* of the selective valve 33 is maintained in the neutral position M3, and the hydraulic pressure of the port-end section 28*a* is guided to the pilot chamber 32*d* of the lock valve 32. Thus, the plunger 32*a* moves to the closed position, and the head-end passage 28 is closed. The boom merging passage 30 is also closed by the check valve 31, and thus the path between the head-end port 2*a* and the first and second boom directional control valves 21, 22 is completely blocked, and the operating oil is prevented from being discharged from the head-end port 2*a*. Therefore, the boom can be held in place in the case where the operating lever 51*a* is not operated.

As with the hydraulic drive system 1 according to Embodiment 1, the hydraulic drive system 1A configured as just described also achieves the fail-safe in the case where the second electromagnetic proportional control valve 42 malfunctions and the valve body thereof is stuck. In other words, also in the hydraulic drive system 1A, the lock valve 32 opens the head-end passage 28 to discharge the operating oil from the head-end port 2*a* only when the first pilot pressure P1 that is the release pressure Pb is output. Therefore, in the case where the operating lever 51*a* is not operated, the control device 50 does not output the first raising signal or the second lowering signal, and thus the closed state of the head-end passage 28 is maintained, as mentioned earlier. Thus, even when the second electromagnetic proportional control valve 42 malfunctions and the valve body thereof is stuck, the operating oil in the head-end port 2*a* is not discharged. This means that the boom can be held in place and it is possible to prevent the boom from falling unwillingly under its own weight. As just described, the hydraulic drive system 1A is capable of achieving the fail-safe even during simultaneous operation of another actuator (in other words, during operation of another operating device) in the case where the valve body of the second electromagnetic proportional control valve 42 is stuck.

When the operating lever 51*a* is pulled down to the other side in the tilt direction in order to lower the boom, the second lowering signal is input to the first electromagnetic proportional control valve 41, and the first pilot pressure P1 is output from the first electromagnetic proportional control valve 41 to the spool 33*a* of the selective valve 33. With this, the spool 33*a* moves to the offset position L3, and the pilot chamber 32*d* of the lock valve 32 is brought into communication with the tank 27 accordingly. Consequently, the pressure of the head-end passage 28 causes the plunger 32*a* to move in the direction opposing the spring member 32*b*, and the port-end section 28*a* and the valve-end section 28*b* of the head-end passage 28 are brought into communication with each other. Thus, the discharge of the operating oil from the head-end port 2*a* to the tank 27 is allowed, and the boom can be lowered.

In the hydraulic drive system 1A configured as described above, the first electromagnetic proportional control valve 41 for actuating the first boom directional control valve 21 serves as a substitute for an electromagnetic proportion valve for actuating the selective valve 33, that is, for actuating the lock valve 32. Therefore, there is no need to additionally provide a dedicated electromagnetic proportional control valve to actuate the lock valve 32, and thus the number of components can be reduced. Aside from this, the hydraulic drive system 1A according to Embodiment 2 produces substantially the same advantageous effects as the hydraulic drive system 1 according to Embodiment 1.

Embodiment 3

Figure 4:
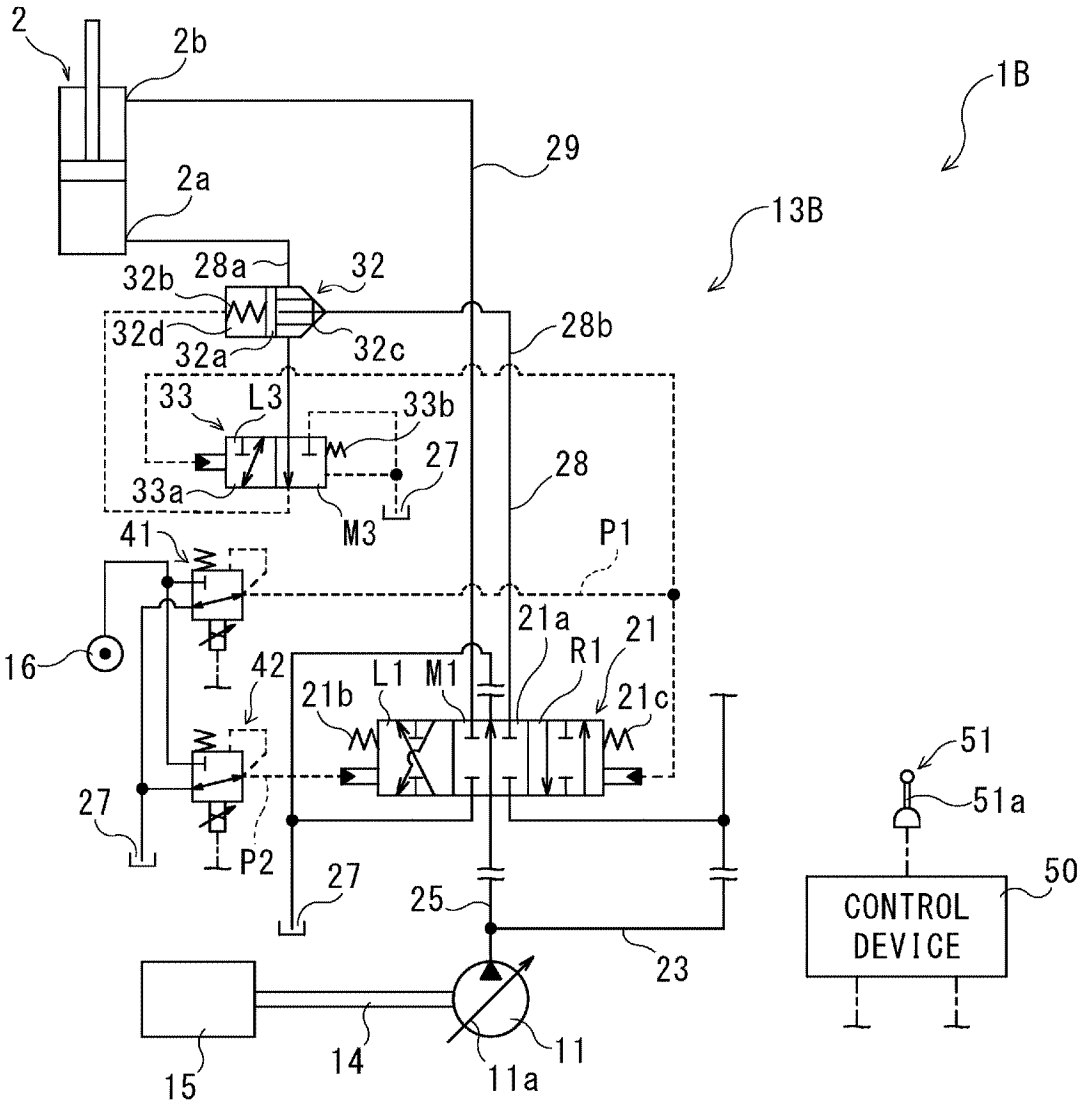
FIG. 4 is a circuit diagram illustrating a hydraulic circuit of a hydraulic drive system according to Embodiment 3.

The hydraulic drive system 1B according to Embodiment 3 illustrated in FIG. 4 is configured to actuate the boom cylinder 2 with only the operating oil dispensed from one hydraulic pump 11; a hydraulic supply device 13B mainly includes the boom directional control valve 21, the lock valve 32, and the selective valve 33 in order to supply the operating oil to the boom cylinder 2. As in the hydraulic supply device 13A according to Embodiment 2, the first electromagnetic proportional control valve 41 is connected to the spool 33*a* of the selective valve 33 in the hydraulic supply device 13B. This means that the first pilot pressure P1 that is output from the first electromagnetic proportional control valve 41 is provided to the spool 33*a* of the selective valve 33 as well. Therefore, the hydraulic drive system 1B is capable of extending and retracting the boom cylinder 2 as with the hydraulic drive system 1A according to Embodiment 2. Furthermore, the hydraulic drive system 1B also achieves the fail-safe in the case where the second electromagnetic proportional control valve 42 malfunctions and the valve body thereof is stuck.

Specifically, in the case where the operating lever 51*a* is not operated, the control device 50 does not output the first raising signal or the second lowering signal, and thus the closed state of the head-end passage 28 is maintained, as mentioned earlier. Thus, even when the second electromagnetic proportional control valve 42 malfunctions and the valve body thereof is stuck, the operating oil in the head-end port 2*a* is not discharged. This means that the boom can be held in place and it is possible to prevent the boom from falling unwillingly under its own weight. Thus, the hydraulic drive system 1B is capable of achieving the fail-safe even during simultaneous operation of another actuator (in other words, during operation of another operating device) in the case where the valve body of the second electromagnetic proportional control valve 42 is stuck.

When the operating lever 51*a* is pulled down to the other side in the tilt direction in order to lower the boom, the second lowering signal is input to the first electromagnetic proportional control valve 41, and the first pilot pressure P1 is output from the first electromagnetic proportional control valve 41 to the spool 33*a* of the selective valve 33. With this, the spool 33*a* moves to the offset position L3, and the pilot chamber 32*d* of the lock valve 32 is brought into communication with the tank 27 accordingly. Consequently, the pressure of the head-end passage 28 causes the plunger 32*a* to move in the direction opposing the spring member 32*b*, and the port-end section 28*a* and the valve-end section 28*b* of the head-end passage 28 are brought into communication with each other. Thus, the discharge of the operating oil from the head-end port 2*a* to the tank 27 is allowed, and the boom can be lowered.

Aside from this, the hydraulic drive system 1B according to Embodiment 3 produces substantially the same advantageous effects as the hydraulic drive system 1A according to Embodiment 2.

Other Embodiments

The foregoing describes the hydraulic drive systems 1, 1A, 1B according to Embodiments 1 to 3 in the case where these are applied to hydraulic excavators, but the subject to which these are applicable is not limited to the hydraulic excavators. Specifically, the hydraulic drive systems 1, 1A, 1B may be applied to construction equipment such as hydraulic cranes and wheel loaders and construction vehicles such as forklifts. Furthermore, the hydraulic drive systems 1, 1A, 1B according to Embodiments 1 to 3 raise and lower the boom, but the object to be raised and lowered is not limited to the boom and may be an arm, a hook of a hoist, and the like. In these cases, the actuator is an arm cylinder and a hoist motor.

Furthermore, in the hydraulic drive systems 1, 1A, 1B according to Embodiments 1 to 3, the first electromagnetic proportional control valve 41 and a bucket electromagnetic proportional control valve 71 are also used as an electromagnetic proportional control valve for providing the pilot pressure to the spool 33*a* of the selective valve 33, but these do not necessarily need to be used in this shared manner; a separate valve may be additionally provided. Moreover, the first to third electromagnetic proportional control valves 41 to 43 are formed separately from the first and second boom directional control valves 21, 22, but these do not necessarily need to be in such a form. Specifically, the first to third electromagnetic proportional control valves 41 to 43 may be formed integrally with the first and second boom directional control valves 21, 22, and the form thereof is not limited. The same applies to the bucket electromagnetic proportional control valves 71, 72 and other electromagnetic proportional control valves.

From the foregoing description, many modifications and other embodiments of the present invention would be obvious to a person having ordinary skill in the art. Therefore, the foregoing description should be interpreted only as an example and is provided for the purpose of teaching the best mode for carrying out the present invention to a person having ordinary skill in the art. Substantial changes in details of the structures and/or functions of the present invention are possible within the spirit of the present invention.

REFERENCE CHARACTERS LIST

1, 1A, 1B hydraulic drive system
2 boom cylinder (first actuator)
2*a* head-end port (first port)
2*b* rod-end port (second port)
3 bucket cylinder (second actuator)
11 first hydraulic pump
12 second hydraulic pump
21 first boom directional control valve (first control valve)
22 second boom directional control valve (second control valve)
32 lock valve
41 first electromagnetic proportional control valve (third electromagnetic proportional control valve)
42 second electromagnetic proportional control valve
43 third electromagnetic proportional control valve
50 control device
51 boom operating device (first operating device)
52 bucket operating device (second operating device)
71 first bucket electromagnetic proportional control valve (third electromagnetic proportional control valve)

The invention claimed is:

1. A hydraulic drive system for raising and lowering an object by supplying and discharging operating oil to and from each of two ports of an actuator, the hydraulic drive system comprising:

a control device that outputs a first lowering signal and a second lowering signal in accordance with a lowering operation performed on an operating device and outputs a raising signal in accordance with a raising operation performed on the operating device, the operating device being used to raise and lower the object;

a first electromagnetic proportional control valve that outputs a first pilot pressure corresponding to the raising signal;

a second electromagnetic proportional control valve that outputs a second pilot pressure corresponding to the first lowering signal;

a third electromagnetic proportional control valve that is different from the second electromagnetic proportional control valve and outputs a third pilot pressure;

a hydraulic pump that dispenses the operating oil;

a first control valve that is connected to the hydraulic pump and each of the two ports of the actuator, is actuated in accordance with a difference between the first pilot pressure and the second pilot pressure, and when the first pilot pressure is higher than the second pilot pressure, causes the operating oil dispensed from the hydraulic pump to be supplied to a first port and causes the operating oil to be discharged from a second port in order to raise the object, and when the second pilot pressure is higher than the first pilot pressure, causes the operating oil dispensed from the hydraulic pump to be supplied to the second port and causes the operating oil to be discharged from the first port in order to lower the object, the first port being one of the two ports of the actuator, the second port being the other of the two ports of the actuator; and a lock valve that is disposed between the first port and the first control valve, is capable of preventing the operating oil from being discharged from the first port by closing a path between the first port and the first control valve, and only when the third pilot pressure is output, allows the operating oil to be discharged from the first port of the actuator by opening the path between the first port and the first control valve, wherein the control device outputs the second lowering signal in accordance with a signal output from the operating device when the lowering operation is performed; and the third electromagnetic proportional control valve outputs the third pilot pressure in accordance with the second lowering signal.

2. A hydraulic drive system for raising and lowering an object by supplying and discharging operating oil to and from each of two ports of an actuator, the hydraulic drive system comprising:

a control device that outputs a first lowering signal in accordance with a lowering operation performed on an operating device and outputs a raising signal in accordance with a raising operation performed on the operating device, the operating device being used to raise and lower the object;

a first electromagnetic proportional control valve that outputs a first pilot pressure corresponding to the raising signal;

a second electromagnetic proportional control valve that outputs a second pilot pressure corresponding to the first lowering signal;

a hydraulic pump that dispenses the operating oil;

a first control valve that is connected to the hydraulic pump and each of the two ports, is actuated in accordance with a difference between the first pilot pressure and the second pilot pressure, and when the first pilot pressure is higher than the second pilot pressure, causes the operating oil dispensed from the hydraulic pump to be supplied to a first port and causes the operating oil to be discharged from a second port in order to raise the object, and when the second pilot pressure is higher than the first pilot pressure, causes the operating oil dispensed from the hydraulic pump to be supplied to the second port and causes the operating oil to be discharged from the first port in order to lower the object, the first port being one of the two ports, the second port being the other of the two ports; and a lock valve that is disposed between the first port and the first control valve, is capable of preventing the operating oil from being discharged from the first port by closing a path between the first port and the first control valve, wherein only when the first pilot pressure that is a predetermined release pressure is output, the lock valve opens the path between the first port and the first control valve to allow the operating oil to be discharged from the first port; and when the first lowering signal is output, the control device outputs a second lowering signal to the first electromagnetic proportional control valve to cause the first electromagnetic proportional control valve to output the first pilot pressure that is the predetermined release pressure.

3. The hydraulic drive system according to claim 1, further comprising:

A hydraulic drive system for raising and lowering an object by supplying and discharging operating oil to and from each of two ports of an actuator, the hydraulic drive system comprising:

a control device that outputs a first lowering signal in accordance with a lowering operation performed on an operating device and outputs a raising signal in accordance with a raising operation performed on the operating device, the operating device being used to raise and lower the object;

a first electromagnetic proportional control valve that outputs a first pilot pressure corresponding to the raising signal;

a second electromagnetic proportional control valve that outputs a second pilot pressure corresponding to the first lowering signal;

a third electromagnetic proportional control valve that is different from the second electromagnetic proportional control valve and outputs a third pilot pressure;

a first hydraulic pump that dispenses the operating oil;

a second hydraulic pump that dispenses the operating oil and is different from the first hydraulic pump;

a first control valve that is connected to the first hydraulic pump and each of the two ports, is actuated in accordance with a difference between the first pilot pressure and the second pilot pressure, and when the first pilot pressure is higher than the second pilot pressure, causes the operating oil dispensed from the first hydraulic pump to be supplied to a first port and causes the operating oil to be discharged from a second port in order to raise the object, and when the second pilot pressure is higher than the first pilot pressure, causes the operating oil dispensed from the first hydraulic pump to be supplied to the second port and causes the operating oil to be discharged from the first port in order to lower the object, the first port being one of the two ports, the second port being the other of the two ports;

a second control valve that is connected to the second hydraulic pump and the first port of a boom cylinder that is the actuator, and when the third pilot pressure that is higher than or equal to a predetermined operating pressure is output from the third electromagnetic proportional control valve, causes the operating oil dispensed from the second hydraulic pump to be supplied to the first port in order to raise a boom that is the object;

a lock valve that is disposed between the first port and the first control valve, is capable of preventing the operating oil from being discharged from the first port by closing a path between the first port and the first control valve, wherein:

only when the third pilot pressure that is a predetermined release pressure lower than the predetermined operating pressure is output, the lock valve opens the path between the first port and the first control valve to allow the operating oil to be discharged from the first port; and when the first lowering signal is output, the control device outputs a second lowering signal to the third electromagnetic proportional control valve to cause the third electromagnetic proportional control valve to output the third pilot pressure that is the predetermined release pressure.

* * * * *